US005725135A

United States Patent [19]

Daniel

[11] Patent Number: 5,725,135

[45] Date of Patent: Mar. 10, 1998

[54] SHOTGUN HOLSTER

[76] Inventor: James A. Daniel, 7 Foxfield La., Blythewood, S.C. 29016

[21] Appl. No.: 703,102

[22] Filed: Aug. 26, 1996

Related U.S. Application Data

[60] Provisional application No. 60/003,334, Sep. 5, 1995.

[51] Int. Cl.[6] ..... F41C 33/00

[52] U.S. Cl. ..... 224/249; 224/913

[58] Field of Search ..... 224/249, 913

[56] References Cited

U.S. PATENT DOCUMENTS

| | | | |
|---|---|---|---|
| D. 162,904 | 4/1951 | Ulvang | 224/913 |
| 1,469,285 | 10/1923 | Thompson | 224/913 |
| 3,501,074 | 3/1970 | Emerick | 224/913 |
| 3,934,768 | 1/1976 | Jones | 224/913 |
| 4,431,122 | 2/1984 | Garmong | 224/913 |

OTHER PUBLICATIONS

Pp. 190–192 of the Fall 1995 Gander Mountain Catalog, Published by GMO, Inc.

Pp. 158 and 267 of 1996 RedHead Catalog, Published by Bass Pro Shops.

*Primary Examiner*—Renee S. Luebke

*Attorney, Agent, or Firm*—Michael A. Mann

[57] ABSTRACT

A holster worn by a shooter for supporting a broken barrel shotgun. The holster is preferably constructed from a first and a second piece of leather. The second piece of leather has a lobe and a cut-out portion so that when the two pieces of leather have been molded, an opening is defined at the lobe. The two pieces of leather also form a belt loop within the holster so that it can be worn by a shooter. The trigger guard of the shotgun is inserted into the opening with the barrel extending toward the ground approximately parallel to the shooter's leg. The trigger guard rests against the second piece of leather with the stock extending over the cut-out portion, so that the lobe will prevent the shotgun from falling away from the shooter. Therefore, in this position the shotgun is supported in a safe and secure manner without the shooter having to manually support the gun.

20 Claims, 1 Drawing Sheet

SHOTGUN HOLSTER

BACKGROUND OF THE INVENTION

This application claims the benefit of U.S. Provisional Application No. 60/003,334 filed date Sep. 5, 1995.

1. Field of the Invention

This invention relates to devices that are carried by a person to support a gun. More specifically, this invention relates to a holster worn on a belt for supporting a broken or open shotgun.

2. Discussion of Background

Target shooting, including trapshooting, skeet, and sporting clays, is a competitive sport in which contestants fire guns at targets simulating the movement of game. Each of these events is becoming an increasingly popular sport, where the shooters shoot at saucer-shaped ceramic targets known as clay pigeons. In both trap shooting and skeet, targets are released in a direction heading away from the shooters from a trap house. Specifically, in trap shooting the targets are released in front of the shooters, who are arrayed in a semi-circle at five adjacent stations, while in skeet high and low flying targets are released from trap houses at either end of a semicircle. In sporting clays the targets are set up and released to simulate hunting conditions.

The guns normally used for shooting in these events are broken barrel type loading guns. These "broken," or open barrel shotguns include single barrel and double barrel shotguns, in which the shooter breaks the gun to either load and unload a shotgun shell. In addition, the double barrel shotguns may have either side-by-side or over-under barrel arrangements.

During each of these events, trapshooting, skeet, and sporting clays, the shooter must carry the shotgun. However, during long delays, the shooter tires from having to carry the gun. Typically, the gun is broken and laid over the shoulder, but this position can also be tiring and uncomfortable. Therefore, there is a need for a device that can be worn by a shooter to safely support a broken barrel shotgun, and which is both easy to manufacture and relatively inexpensive.

SUMMARY OF THE INVENTION

According to its major aspects and broadly stated, the present invention is a shotgun holster. In its preferred embodiment, the holster is a two-piece leather device that attaches to a shooter's belt. The holster comprises a first piece of leather and a second piece of leather. The first and second pieces of leather are stitched together at the four corners of the second piece proximate to the top end of the first piece of leather. The stitching pattern forms a belt loop within the holster so that it can be supported on a wide belt worn by a shooter.

The second piece of leather is longer than the first piece of leather in its stretched out state and has a lobe portion and a cut-out portion. The second piece of leather is molded in a process known to those skilled in the art of leather making, so that the lobe portion extends away from the shooter, and the cut-out portion is positioned so that it faces in the same direction as the shooter. This molding process gives the holster some rigidity so that the leather will retain its shape.

In operation, the shooter first positions the holster on the right side of the body, if right handed. A broken barrel shotgun is then broken into the open position, and the trigger guard is inserted into an opening in the holster with the barrel extending towards the ground approximately parallel to the shooter's leg. The opening is defined by the space between the first and second pieces of leather at the lobe. The shotgun rests with its trigger guard on the second piece of leather, covered by the lobe, with the front of the trigger guard oriented so that the stock crosses over the cut-out portion. The lobe prevents the trigger guard of the gun from falling out of the holster or pivoting away from the shooter. Therefore, the holster supports the gun safely and securely in the broken (open) position.

In the preferred embodiment, the holster is designed to be worn on the shooter's right side. However, by reversing the construction of the second piece of leather, the holster can be modified to be worn on the shooter's left side.

An important feature of the present invention is the ability of the holster to attach to a belt worn by the shooter. When in this position, the holster will support a broken shotgun, thereby relieving the shooter from carrying the gun by hand. In addition, the lobe, cut-out portion, and opening for the trigger guard cooperate to securely hold the shotgun within the holster.

Another feature of the present invention is that the holster will only support the gun in the broken position. Therefore, the shooter will always have confidence that the gun is not in a firing position. Furthermore, the shooter will easily be able to look and see if the gun is loaded.

Still another feature of the present invention is low cost and easy construction of the holster. The holster in its preferred embodiment is constructed from two pieces of leather that are molded into its preferred shape. In addition, the same stitching is used to both define a belt loop and define the shape of the holster. The holster should, therefore, be sufficiently easy and inexpensive to manufacture.

Other features and advantages of the present invention will be apparent to those skilled in the art from a careful reading of the Detailed Description of a Preferred Embodiment presented below and accompanied by the drawings.

DETAILED DESCRIPTION OF A PREFERRED EMBODIMENT

Figure 2:
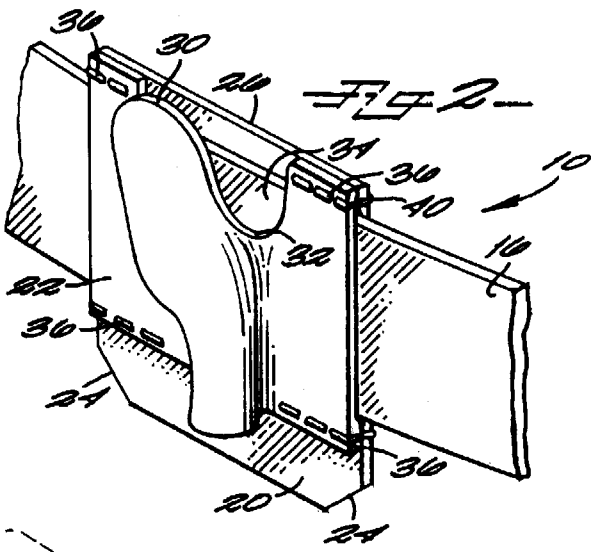
FIG. 2 is a perspective view of a holster shown attached to a belt for clarity, according to a preferred embodiment of the present invention.

In the following description, similar components are referred to by the same reference numeral in order to simplify the understanding of the sequential aspect of the drawings.

Figure 3:
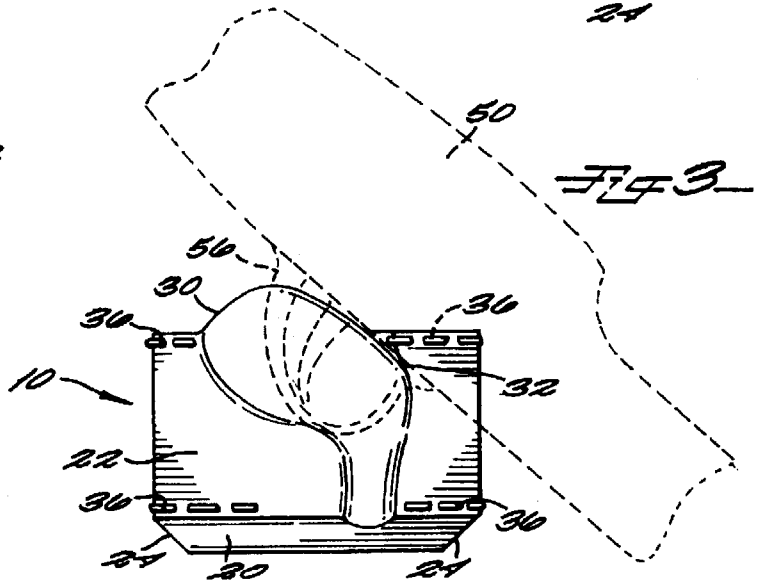
FIG. 3 is a side view of a holster supporting a shotgun, shown in phantom lines for clarity, according to a preferred embodiment of the present invention.
Figure 1:
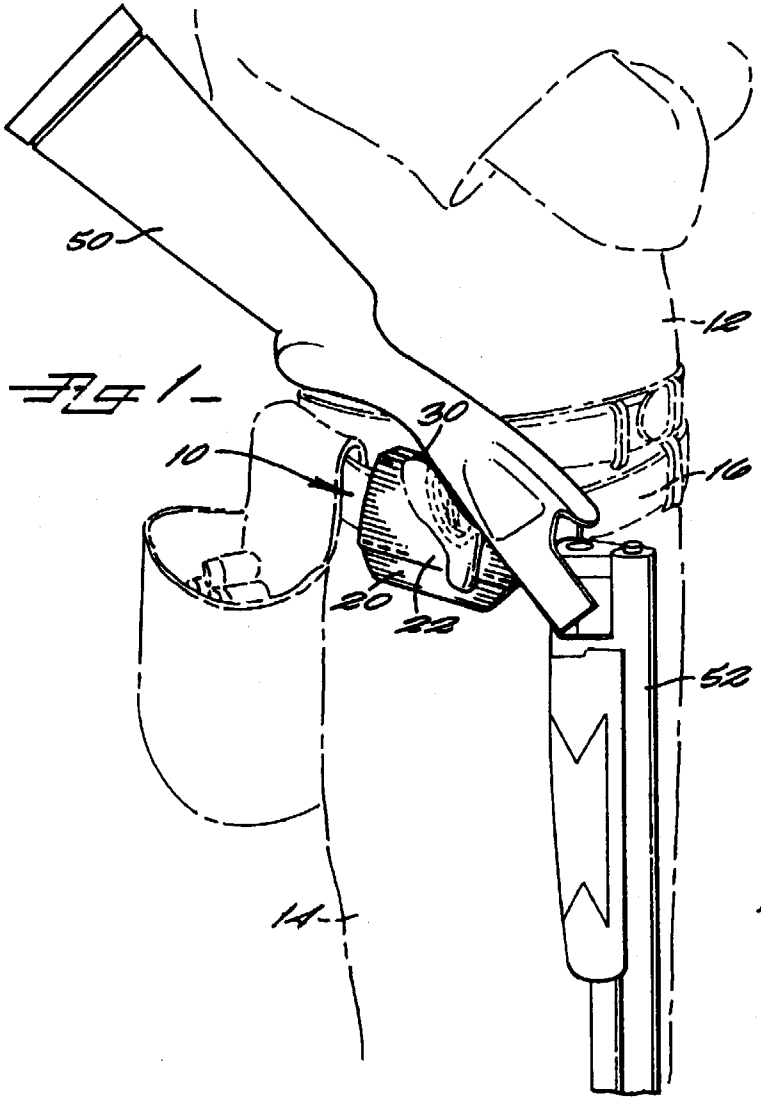
FIG. 1 is a perspective view of a holster worn on a belt around the waist of a shooter supporting a shotgun, according to a preferred embodiment of the present invention.

Referring now to FIGS. 1, 2, and 3, a shotgun holster (hereinafter holster) 10 is shown according to a preferred embodiment. Holster 10 fits on a belt 16 worn by a shooter 12, so that it will support a shotgun 50 with its barrel 52 extending toward the ground approximately parallel to the leg 14 of the shooter 12. Holster 10 will securely hold shotgun 50 while the shooter 12 is walking and moving, even though no additional straps or snapping devices are provided. However, these devices may be added if so desired.

Holster 10 comprises a first piece 20 and a second piece 22. In the preferred embodiment, first piece 20 and second piece 22 are made of leather. First piece 20 has a top end 26 and is approximately square, but may have chamfered edges 24 for both functional and aesthetic purposes. In a flat unmolded state, second piece 22 is longer than first piece 20 and comprises a lobe 30 and a cut-out portion 32. First piece 20 and second piece 22 are stitched together at stitches 36, with second piece 22 positioned proximate to top end 26 so that lobe 30 extends above first piece 20. Additionally, in the preferred embodiment, first piece 20 is taller or has a longer height than second piece 22, which helps prevent holster 10 from twisting on shooter 12, and thus prevents shotgun 50 from falling to the ground. In other words, by having first piece 20 taller than second piece 22, so that first piece 22 extends below second piece 22, the lower portion of first piece 20 engages the leg 14 of the shooter 12, thus cantilevering itself so that belt 16 does not twist, which would cause shotgun 50 to fall to the ground.

Stitches 36 are placed so that a belt loop 40 is formed within holster 10 between first piece 20 and second piece 22. Belt loop 40 is bound on the top and bottom by stitches 36. Belt loop 40 allows the shooter 12 to insert a belt 16 through belt loop 40 so that holster 10 is on the right side of the shooter 12. Holster 10 in its preferred embodiment is designed to be worn on the right side of the body, but by reversing second piece 22 during manufacture, holster 10 can be easily adapted for wearing on the left side.

More specifically, stitches 36 are positioned in each of the corners of second piece 22 and connected to first piece 20 at its upper corners. First piece 20 must have at least the same height as second piece 22 or stitches 36 will not form belt loop 40. Moreover, because stitches 36 are positioned in the corners of second piece 22, belt loop 40 has a height just less than the height of second piece 22. As stated above, belt loop 40 is defined by the top and bottom stitches 36 and the surfaces of first piece 20 and second piece 22.

After stitching first piece 20 and second piece 22 together, second piece 22 is molded so that lobe 30 extends away from first piece 20 and cut-out portion 32 faces in the same direction as the shooter 12. This molding process can be any process known to those skilled in the art of leather making, so long as second piece 22 retains its molded shape. After the molding process, an opening 34 is defined by the space between first piece 20 and second piece 22 at lobe 30. As defined, opening 34 is dimensioned so that the trigger guard 56 of the shotgun 50 will fit therein.

In operation, holster 10 is worn on the belt 16 on the right side of the shooter 12 with cut-out portion 32 facing in the same direction as shooter 12. After finishing with shotgun 50, shotgun 50 is broken into the open position, preferably unloaded. In the open position, trigger guard 56 of shotgun 50 is inserted into opening 34. Shotgun 50 rests with trigger guard 56 on cut-out portion 32 of second piece 22 of leather, covered by lobe 30, with the front of trigger guard 56 oriented so that the stock of shotgun 50 crosses over cut-out portion 32, and barrel 52 extends down toward the ground approximately parallel to the leg 14 of the shooter 12. In other words, opening 34 is adapted to support the shotgun 50 from its trigger guard 56. Moreover, the center of gravity of the broken shotgun 50 is thus not so far forward of cut-out portion 32, that its trigger guard 56 will rotate out of position in holster 10. In addition, lobe 30 extending above first piece 20 prevents shotgun 50 from falling sideways out of holster 10. Lobe 30 engages trigger guard 56 and keeps shotgun 50 from pivoting away from the shooter's 12 body, which could result in shotgun 50 falling to the ground. Therefore, cut-out portion 32, lobe 30, first piece 20, and second piece 22 cooperate to securely hold shotgun 50 in holster 10.

When shotgun 50 is in the broken or open position, it is also easy for the shooter 12 to look and see if shotgun 50 is loaded. This adds a degree of safety to holster 10, because the shooter 12 will always be able to tell if shotgun 50 is loaded. Furthermore, in this position, shotgun 50 is not in a firing position, thereby reducing the chances of an accident. However, in the present holster 10, shotgun 50 can be readied for firing quickly.

The preferred embodiment of holster 10 is a two-piece leather construction; however, there are other materials, including plastics and fibers, that have sufficient strength and rigidity to support the gun. Furthermore, the holster does not have to be constructed from a two-piece design, but could be formed by a mold or extrusion process, or could be formed in a single piece or multi-piece design. However, holster 10 must be strong enough and rigid enough to support the weight of shotgun 50. Those of ordinary skill in the an will recognize that these modifications and changes may be made without departing from the spirit and scope of the present invention.

Additionally, it will be apparent to those skilled in the art that many other changes and substitutions can be made to the preferred embodiment herein described without departing from the spirit and scope of the present invention as defined by the appended claims.

What is claimed is:

1. A holster for supporting a shotgun in the broken position by a belt worn on a shooter, said holster comprising:

a first piece having a top end; and a second piece attached to said first piece to define a belt loop therebetween, said first piece and said second piece formed to define an opening between said first piece and said second piece, said opening adapted to receive a trigger guard wherein a shotgun is supported by said first piece and said second piece, said second piece having a lobe dimensioned to cover the trigger guard when the shotgun is in said holster.

2. The holster as recited in claim 1, wherein said second piece has a cut-out portion dimensioned to receive the trigger guard.

3. The holster as recited in claim 1, wherein said lobe extends above said top end of said first piece and prohibits the shotgun from pivoting away from the shooter.

4. The holster as recited in claim 1, wherein said first piece and said second piece are leather.

5. The holster as recited in claim 1, wherein said first piece and said second piece are attached together by top and bottom stitches, said top and bottom stitches defining said belt loop therebetween.

6. The holster as recited in claim 1, wherein said first piece and said second piece are attached together by stitches.

7. The holster as recited in claim 1, wherein said first piece is taller than said second piece.

8. The holster as recited in claim 1, wherein said first piece has a pair of chamfered edges and said second piece has a flat unmolded state; and wherein said second piece is longer than said first piece, when said second piece is in said flat, unmolded state.

9. The holster as recited in claim 1, wherein said first piece is taller than said second piece; and wherein said first piece is attached to said second piece by stitches.

10. An apparatus for supporting a shotgun in the broken position on a shooter, said apparatus comprising:

a belt adapted to surround the shooter;

a holster dimensioned to receive said belt, said holster having a cut-out portion, a lobe, and an opening at said lobe, said opening adapted to receive the shotgun's trigger guard so that said lobe covers the shotgun's trigger guard when the shotgun is being supported by said holster.

11. The apparatus as recited in claim 10, wherein said first piece and said second piece are leather.

12. The apparatus as recited in claim 10, wherein said lobe extends above said belt loops and covers the shotgun's trigger guard when the trigger guard is positioned within said opening.

13. The apparatus as recited in claim 10, wherein said holster further comprises a first piece and a second piece, said first piece being taller than said second piece, said opening and said belt loops defined between said first piece and said second piece.

14. The apparatus as recited in claim 10, wherein said holster comprises a first piece and a second piece, said first piece having a lower portion that engages the leg of the shooter, thus preventing said belt from twisting on the shooter when the shotgun is carded by said holster.

15. A method for making a holster that supports a shotgun in the broken position on a belt worn by the shooter, said method comprising the steps of:

obtaining a first piece of material, said first piece having a top end;

obtaining a second piece of material having a cut-out portion, a lobe, said second piece of material being in a flat, unmolded state;

connecting said first piece to said second piece to define a belt loop therebetween, said belt loop adapted to receive the belt therethrough, said lobe extending above said top end of said first piece; and forming said second piece to define an opening at said lobe and between said first piece and said second piece, said opening adapted to receive the shotgun's trigger guard therein.

16. The method as recited in claim 15, wherein said first piece and said second piece are leather, said second piece being longer than said first piece when said second piece is in said flat, unmolded state.

17. The method as recited in claim 15, wherein said first piece is taller than said second piece.

18. The method as recited in claim 15, wherein said second piece is connected to said first piece by stitches.

19. The method as recited in claim 15, wherein said first piece has a lower portion extending below said second piece, said lower portion engaging the shooter's leg when said holster is supporting the shotgun on the shooter.

20. The method as recited in claim 15, wherein said cut-out portion and said opening are dimensioned to receive the trigger guard of the shotgun, so that its barrel extends toward the ground approximately parallel to the shooter's leg.

* * * * *